US007547497B2

(12) United States Patent
Uchinokura et al.

(10) Patent No.: US 7,547,497 B2
(45) Date of Patent: Jun. 16, 2009

(54) TONER, AND DEVELOPER, IMAGE DEVELOPER AND IMAGE FORMING APPARATUS USING THE TONER

(75) Inventors: Osamu Uchinokura, Numazu (JP); Masami Tomita, Numazu (JP); Hisashi Nakajima, Numazu (JP); Shinya Nakayama, Numazu (JP); Koichi Sakata, Numazu (JP); Akihiro Kotsugai, Numazu (JP); Tomoyuki Ichikawa, Kawasaki (JP); Yasuo Asahina, Numazu (JP); Hideki Sugiura, Fuji (JP); Yasuaki Iwamoto, Numazu (JP); Satoshi Mochizuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 11/080,542

(22) Filed: Mar. 16, 2005

(65) Prior Publication Data

US 2005/0208408 A1 Sep. 22, 2005

(30) Foreign Application Priority Data

Mar. 16, 2004 (JP) ..... 2004-073823

(51) Int. Cl.
*G03G 9/087* (2006.01)

(52) U.S. Cl. ..... 430/108.2; 430/108.22; 430/108.4; 430/113.3; 430/137.3

(58) Field of Classification Search ..... 403/108.2, 403/108.22, 108.4, 113.3, 137.3
See application file for complete search history.

(56) References Cited

U.S. PATENT DOCUMENTS 3,565,654 A 2/1971 Story
6,037,090 A 3/2000 Tanaka et al.
6,360,068 B1 3/2002 Kinoshita et al.
6,416,914 B1 7/2002 Nakamura et al.
6,432,590 B1 8/2002 Ueda et al.
6,503,676 B2 1/2003 Yamashita et al.
6,733,939 B2 5/2004 Nanya et al.
6,740,460 B2 5/2004 Tomita et al.
6,787,280 B2 * 9/2004 Yamashita et al. ..... 430/111.4
6,818,370 B2 11/2004 Uchinokura et al.
6,849,369 B2 * 2/2005 Yagi et al. ..... 430/110.4
6,887,636 B2 * 5/2005 Matsuda et al. ..... 430/108.1
6,936,390 B2 8/2005 Nanya et al.
6,946,229 B2 * 9/2005 Suzuki et al. ..... 430/109.4
7,157,201 B2 * 1/2007 Tomita et al. ..... 430/109.4

(Continued)

FOREIGN PATENT DOCUMENTS

EP 0 587 036 A2 3/1994

(Continued)

OTHER PUBLICATIONS

U.S. Appl. No. 11/950,114, filed Dec. 4, 2007, Shitara, et al.

(Continued)

*Primary Examiner*—Hoa V Le
(74) *Attorney, Agent, or Firm*—Oblon, Spivak, McClelland, Maier & Neustadt, P.C.

(57) ABSTRACT

A toner which is negatively charged to develop an electrostatic latent image is provided that contains a colorant; and a binder resin, wherein the toner has an acid value of from 5 to 20 mg KOH/g and an amine value of from 0.5 to 10 mg KOH/g.

11 Claims, 1 Drawing Sheet

U.S. PATENT DOCUMENTS

| | | | | |
|---|---|---|---|---|
| 2003/0022080 | A1 | 1/2003 | Fushimi et al. | |
| 2003/0104297 | A1* | 6/2003 | Matsuda et al. | 430/108.3 |
| 2003/0138717 | A1* | 7/2003 | Yagi et al. | 430/110.4 |
| 2005/0003289 | A1 | 1/2005 | Fushimi et al. | |
| 2005/0026064 | A1 | 2/2005 | Sugiura et al. | |
| 2005/0208408 | A1 | 9/2005 | Uchinokura et al. | |

FOREIGN PATENT DOCUMENTS

| | | | |
|---|---|---|---|
| EP | 1 387 225 | A1 | 2/2004 |
| JP | 1-288863 | | 11/1989 |
| JP | 3-160015 | | 7/1991 |
| JP | 10-265758 | | 10/1998 |
| JP | 11-72958 | | 3/1999 |
| JP | 11-149180 | | 6/1999 |
| JP | 2002-202626 | | 7/2002 |
| JP | 2002-202632 | | 7/2002 |
| JP | 2003-107777 | | 4/2003 |
| JP | 2003-140381 | | 5/2003 |
| JP | 2003-280269 | | 10/2003 |
| JP | 2004-4414 | | 1/2004 |

OTHER PUBLICATIONS

Patent Abstracts of Japan, JP 10-333355, Dec. 18, 1998.
Patent Abstracts of Japan, JP 11-352725, Dec. 24, 1999.
U.S. Appl. No. 11/558,736, filed Nov. 10, 2006, Osamu Uchinokura, et al.
U.S. Appl. No. 11/685,969, filed Mar. 14, 2007, Uchinokura, et al.
U.S. Appl. No. 10/959,663, filed Oct. 7, 2004, Sugiura, et al.
U.S. Appl. No. 10/969,076, filed Oct. 21, 2004, Uchinokura, et al.
U.S. Appl. No. 11/338,700, filed Jan. 25, 2006, Kotsugai, et al.
U.S. Appl. No. 11/080,542, filed Mar. 16, 2005, Uchinokura, et al.
U.S. Appl. No. 11/081,738, filed Mar. 17, 2005, Nakayama, et al.
U.S. Appl. No. 11/519,057, filed Sep. 12, 2006, Nakayama, et al.
U.S. Appl. No. 11/512,385, filed Aug. 30, 2006, Tomita.
U.S. Appl. No. 11/289,488, filed Nov. 30, 2005, Shimojo et al.
U.S. Appl. No. 11/851,475, filed Sep. 7, 2007, Watanabe, et al.
U.S. Appl. No. 11/852,778, filed Sep. 10, 2007, Nagatomo, et al.
U.S. Appl. No. 11/853,490, filed Sep. 11, 2007, Miyamoto, et al.
U.S. Appl. No. 11/857,791, filed Sep. 19, 2007, Kojima, et al.
U.S. Appl. No. 11/956,378, filed Dec. 14, 2007, Shu, et al.
U.S. Appl. No. 11/943,713, filed Nov. 21, 2007, Ishikawa, et al.
U.S. Appl. No. 11/685,872, filed Mar. 14, 2007, Uchinokura, et al.
U.S. Appl. No. 12/046,011, filed Mar. 11, 2008, Nagatomo, et al.
U.S. Appl. No. 12/047,807, filed Mar. 13, 2008, Honda, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 12/048,823, filed Mar. 14, 2008, Honda, et al.
U.S. Appl. No. 12/050,502, filed Mar. 18, 2008, Yamada, et al.
U.S. Appl. No. 12/203,278, filed Sep. 3, 2008, Yamada, et al.
U.S. Appl. No. 12/252,693, filed Oct. 16, 2008, Sakata.
U.S. Appl. No. 12/297,952, filed Oct. 21, 2008, Iwamoto, et al.

* cited by examiner

FIGURE
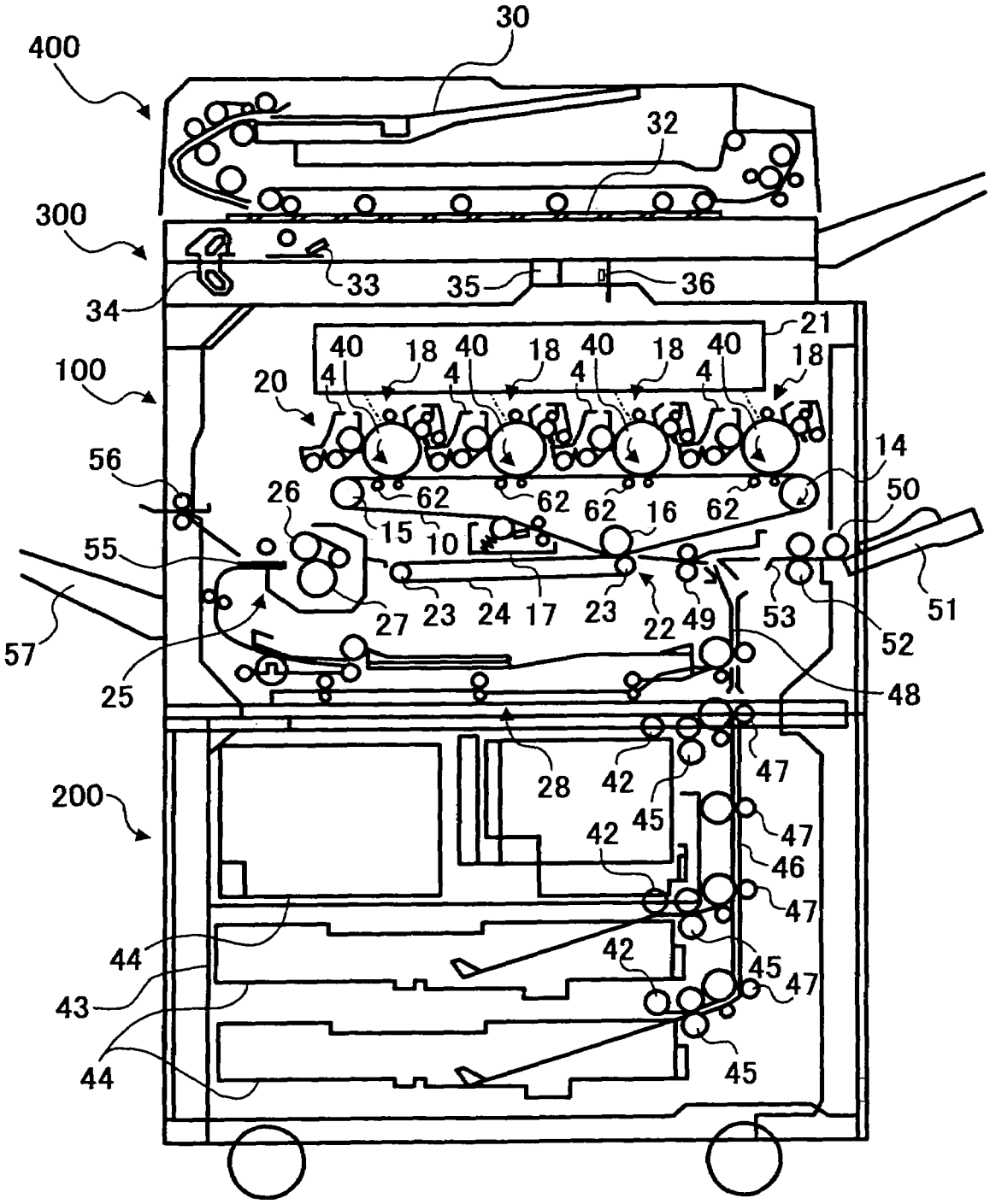

TONER, AND DEVELOPER, IMAGE DEVELOPER AND IMAGE FORMING APPARATUS USING THE TONER

BACKGROUND OF THE INVENTION

1. Field of the Invention

The present invention relates to a toner and a developer using the toner for use in electrophotographic image forming processes in copiers facsimiles, printers, etc., and to an image developer and an image forming apparatus using the developer.

2. Discussion of the Background

Recently, toners for use in electrophotographic image forming processes are having smaller particle diameters and ensphered to comply with increasing demands for higher quality images. When a toner has a smaller particle diameter, the toner has better reproducibility of a dot. When ensphered, the toner has better developability and transferability. Since conventional kneading and pulverizing methods of preparing a toner have much difficulty in preparing such an ensphered toner having a smaller particle diameter, polymerized toners prepared by a suspension polymerization method, an emulsion polymerization method, a dispersion polymerization method or the like method are being used.

However, the polymerized toners still have some problems to be solved. The polymerized toners are studied from various aspects to have better powder fluidity and transferability by reducing a particle diameter thereof and being ensphered, and have good thermostable preservability, low-temperature fixability and hot offset resistance. For example, Japanese Laid-Open Patent Publication No. 11-149180 discloses a method of dispersing toner constituents including a prepolymer including an isocyanate group in an aqueous medium, and adding amines thereto such that a cross-linking reaction and/or an elongation reaction of the prepolymer are performed to prepare a toner. Such a reaction can prepare a toner having a polymer outer shell, which can improve thermostable preservability of the toner.

In the above-mentioned method, depending on volume ratios of materials included in the toner constituents, performances of the reactions in the aqueous medium differ, resulting in preparation of a toner not having a desired particle diameter or a toner not having desired chargeability. Particularly when the toner constituents include the amines as above, the resultant toner tends to be positively charged. Therefore, an influence on chargeability of a toner of such positively charging constituents needs to be considered to prepare a toner to be negatively charged, which is used in negatively charging reverse developing methods.

Because of these reasons, a need exists for a stable negatively-charged toner having a small particle diameter distribution, good developability, transferability, low-temperature fixability, hot offset resistance and thermostable preservability.

SUMMARY OF THE INVENTION

Accordingly, an object of the present invention is to provide a toner stably and negatively charged, having a small particle diameter distribution, good developability, transferability, low-temperature fixability, hot offset resistance and thermostable preservability.

This object and other objects of the present invention, either individually or collectively, have been satisfied by the discovery of a toner comprising a colorant; and a binder resin, wherein the toner is negatively charged to develop an electrostatic latent image, and has an acid value of from 5 to 20 mg KOH/g and an amine value of from 0.5 to 10 mg KOH/g.

The acid value is preferably larger than the amine value by not less than 2 mg KOH/g.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a perspective view illustrating an embodiment of the image forming apparatus of the present invention.

DETAILED DESCRIPTION OF THE INVENTION

The present invention provides a toner stably and negatively charged, having a small particle diameter distribution, good developability, transferability, low-temperature fixability, hot offset resistance and thermostable preservability. In addition, the present invention provides an image developer and an image forming apparatus producing high-quality and high-definition images, using the toner as a developer.

The toner of the present invention is a negatively-charged toner comprising a colorant and a binder resin, and having an acid value of from 5 to 20 mg KOH/g and an amine value of from 0.5 to 10 mg KOH/g. A toner having an acid value and am amine value in such ranges respectively balances the negatively-charged constituents and positively-charged constituents such that the toner is stably and negatively charged. In addition, such a toner has a small particle diameter distribution. Therefore, the toner has good developability and transferability.

A toner having an acid value less than 5 mg KOH/g is difficult to control a particle diameter thereof and has poor fixability. When greater than 20, the toner has high chargeability, but the chargeability largely deteriorates and is unstable under an environment of high temperature and high humidity.

A toner having an amine value less than 0.5 mg KOH/g tends to be difficult to control a particle diameter thereof. When greater than 10, the toner is not stably and negatively charged. A toner preferably has an amine value of from 0.5 to 5 mg KOH/g to have stable chargeability.

Particularly to stabilize a negatively-charged toner, the toner needs to have an acid value larger than an amine value thereof, and a difference therebetween needs to be not less than 2 mg KOH/g. When less than 2 mg KOH/g, the toner does not have good chargeability.

The acid value (mg KOH/g) of the toner can be measured according to JIS K 0070. The amine value (mg KOH/g) of the toner can be measured according to ASTM D 2074.

The toner of the present invention may be prepared by the pulverization methods or polymerization methods.

An embodiment of the pulverization methods includes fully mixing a binder resin, a colorant and optionally a charge controlling agent, a release agent and other additives in a mixer such as HENSCHEL MIXER; fully kneading a mixture thereof with a thermal kneader such as a batch-type two roll mixer, BUMBRY'S MIXER, a continuous biaxial extruder and a continuous uniaxial kneader; extending the kneaded mixture upon application of pressure; cooling the extended mixture; shearing the cooled mixture; crushing the sheared mixture with a hammer mill, etc.; pulverizing the crushed mixture with a pulverizer such as a pulverizer using a jet stream and a mechanical pulverizer; classifying the pulverized mixture with a classifier such as a classifier using whiling air stream and a classifier using Co and a effect such that the pulverized particles have a predetermined particle diameter; and externally adding an particulate inorganic material to the particles with a mixer to prepare a toner.

The toner of the present invention is preferably prepared by dissolving or dispersing toner constituents comprising a polymerizing monomer and/or a binder resin and nitrogen compound in an organic solvent to prepare a solution or a dispersion; and dispersing the solution or dispersion in an aqueous medium to granulate the solution or dispersion. The toner constituents may include a colorant, a release agent, a charge controlling agent besides the polymerizing monomer, binder resin and nitrogen compound.

When the toner constituents have an acid value larger than an amine value thereof and a difference therebetween is from 3 to 10 mg KOH/g, the resultant toner has good negative chargeability.

The above-mentioned granulating process may include a polymerization reaction, a cross-linking reaction, an elongation reaction, etc. When such reactions are included, the toner constituents having an acid value and amine value in proper ranges respectively can accelerate the reactions and toner particles can stably be granulated. The acid value is preferably from 3 to 15 mg KOH/g and the amine value is preferably from 0.5 to 12 mg KOH/g. Further, the toner constituents having an acid value and amine value in such ranges can prepare a toner having an acid value and an amine value in the above-mentioned ranges respectively.

The toner of the present invention can be prepared by dissolving or dispersing toner constituents comprising a polyester prepolymer having a functional group including a nitrogen atom, a polyester resin, a colorant and a compound including a nitrogen atom in an organic solvent to prepare a solution or a dispersion; and dispersing the solution or dispersion in an aqueous medium such that a cross-linking reaction and/or an elongation reaction of the toner constituents perform.

Hereinafter, specific materials used for preparing the toner of the present invention will be explained.

The organic solvents are not particularly limited provided they can dissolve or disperse the toner constituents. The solvent is preferably volatile and has a boiling point lower than 150° C., from the viewpoint of being easily removed from the dispersion. Specific examples of such a solvent include, but are not limited to, toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, tetrahydrofuran, etc. These solvents can be used alone or in combination. Among these solvents, the methyl acetate and ethyl acetate are preferably used because of easily vaporizing after toner particles are formed. The organic solvent is used in an amount of from 40 to 300 parts, preferably from 60 to 140, and more preferably from 80 to 120 parts by weight per 100 parts by weight of solid contents of the toner constituents.

In the present invention, a polyester prepolymer having an isocyanate group can be used as a modified polyester resin. The polyester prepolymer (A) is formed from a reaction between polyester having an active hydrogen atom formed by polycondensation between a polyol (1) and a polycarboxylic acid (2), and polyisocyanate (3). Specific examples of the groups including the active hydrogen include a hydroxyl group (such as an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyols having 3 valences or more (1-2) can be used, and (1-1) alone or a mixture of (1-1) and a small amount of (1-2) are preferably used.

Specific examples of diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, an alkylene glycol having 2 to 12 carbon atoms and adducts of bisphenol with an alkylene oxide are preferably used, and a mixture thereof is more preferably used.

Specific examples of the polyol having 3 valences or more (1-2) include multivalent aliphatic alcohols having 3 to 8 or more valences such as glycerin, trimethylolethane, trimethylolpropane, pentaerythritol and sorbitol; phenols having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acids (2-1) and polycarboxylic acids having 3 or more valences (2-2) can be used. (2-1) alone, or a mixture of (2-1) and a small amount of (2-2) are preferably used.

Specific examples of the dicarboxylic acid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylene dicarboxylic acid having 4 to 20 carbon atoms and an aromatic dicarboxylic acid having 8 to 20 carbon atoms are preferably used.

Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between one or more of the polyols (1) and an anhydride or lower alkyl ester of one or more of the above-mentioned acids. Suitable preferred lower alkyl esters include, but are not limited to, methyl esters, ethyl esters and isopropyl esters.

Since alcoholic hydroxyl-terminated polyester is prepared by a polyesterification reaction, the polyol (1) and polycarboxylic acid (2) are mixed such that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) reacted with the alcoholic hydroxyl group of the polyester to prepare the polyester prepolymer include aliphatic polyisocyanates such as tetramethylenediisocyanate, hexamethylenediisocyanate and 2,6-diisocyanatemethylcaproate; alicyclic polyisocyanates such as isophorondiisocyanate and cyclohexylmethanediisocyanate; aromatic diisocyanates such as tolylenedisocyanate and diphenylmethanediisocyanate; aromatic aliphatic diisocyanates such as α, α, α', α'-tetramethylxylylenediisocyanate; isocyanurates; the above-mentioned polyisocyanates blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, quantity of the isocyanate group included in the polyester prepolymer (A) is too small to perform a cross-linking reaction and/or an elongation reaction with a compound including an active hydrogen atom, which is mentioned later.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the modified polyester resin after the cross-linking reaction and/or the elongation reaction has a low molecular weight, and the resultant toner does not have sufficient hot offset resistance.

The toner of the present invention preferably includes not only the polyester prepolymer (A) but also an unmodified unreactive polyester resin (C) to improve low-temperature fixability and glossiness thereof when used in a full-color image forming apparatus.

Specific examples of the unmodified unreactive polyester resin (C) include polycondensated products between the polyol (1) and polycarboxylic acid (2) similarly to the polyester prepolymer (A), and products preferably used are the same as those thereof. The unmodified unreactive polyester (C) can be substituted with another modified polyester other than a urea-modified polyester such as a urethane-modified polyester.

It is preferable that the polyester prepolymer (A) and unmodified unreactive polyester resin (C) are partially soluble each other in terms of the low-temperature fixability and hot offset resistance of the resultant toner. Therefore, the polyester prepolymer (A) and unmodified unreactive polyester resin (C) preferably have similar compositions.

When the unmodified unreactive polyester resin (C) is used in combination, a weight ratio ((A)/(C)) between the polyester prepolymer (A) and unmodified unreactive polyester resin (C) is from 5/95 to 75/25, preferably from 10/90 to 25/75, more preferably from 12/88 to 25/75, and most preferably from 12/88 to 22/78. When the polyester prepolymer (A) has a weight ratio less than 5%, the resultant toner has a poor hot offset resistance, and has a difficulty in having a thermostable preservability and a low-temperature fixability.

The unmodified unreactive polyester resin (C) preferably has a peak molecular weight of from 1,000 to 30,000, preferably from 1,500 to 10,000, and more preferably from 2,000 to 8,000 when measured by a method using gel permeation chromatography (GPC). When less than 1,000, the thermostable preservability of the resultant toner deteriorates. When greater than 10,000, the low-temperature fixability thereof deteriorates.

The unmodified unreactive polyester resin (C) preferably has a hydroxyl value not less than 5 mg KOH/g, more preferably of from 10 to 120 mg KOH/g, and most preferably from 20 to 80 mg KOH/g. When less than 5, the resultant toner has a difficulty in having a thermostable preservability and a low-temperature fixability. The unmodified unreactive polyester resin (C) preferably has an acid value of from 0.5 to 40 mg KOH/g, and more preferably from 5 to 35 mg KOH/g. When less than 0.5 or greater than 40, the toner constituents in the organic solvent is difficult to have an acid value of from 3 to 15 mg KOH/g, and therefore the resultant toner has neither a desired particle diameter nor a desired distribution thereof. In addition, when greater than 40 mg KOH/g, the resultant toner is not stably and negatively charged.

As mentioned later, the polyester prepolymer (A) having an isocyanate group is subjected to a cross-linking reaction and/or an elongation reaction with a compound including a hydrogen atom to produce a modified polymer polyester resin.

Specific examples of the compound including a hydrogen atom include amines. Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorondiamine; aliphatic diamines such as ethylene diamine, tetramethylene diamine and hexamethylene diamine, etc.

Specific examples of the polyamines (B2) having three or more amino groups include diethylene triamine, triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc.

Among these amines (B), diamines (B1) and mixtures in which a diamine is mixed with a small amount of a polyamine (B2) are preferably used.

A mixing ratio (i.e., a ratio [NCO]/[NHx]) of the content of the polyester prepolymer (A) having an isocyanate group to the amines (B) is from 1/2 to 2/1, preferably from 1.5/1 to 1/1.5 and more preferably from 1.2/1 to 1/1.2. When the mixing ratio is greater than 2 or less than ½, the molecular weight of a urea-modified polyester produced by the cross-linking reaction and/or the elongation reaction decreases, resulting in deterioration of hot offset resistance of the resultant toner.

The molecular weight of the modified polyesters after reacted can optionally be controlled using an elongation anti-catalyst, if desired. Specific examples of the elongation anti-catalyst include monoamines such as diethyl amine, dibutyl amine, butyl amine and lauryl amine, and blocked amines, i.e., ketimine compounds prepared by blocking the monoamines mentioned above.

The compound including a nitrogen atom is included in the toner constituents in the organic solvent and serves for the toner constituents to have an acid value in a proper range. In a process of preparing the toner of the present invention, when the toner constituents includes too many acidic elements due to the unreactive polyester (C), the above-mentioned cross-linking reaction and/or elongation reaction between the polyester prepolymer (A) and the amines (B) are difficult to perform. Therefore, a salt formed from a reaction between the compound including a nitrogen atom and the unreactive polyester (C) excludes influences of the acidic elements included in the toner constituents to accelerate the cross-linking reaction and/or the elongation reaction. In addition, an amount of the compound including a nitrogen atom is controlled such that the toner constituents have an acid value in a proper range to stably prepare a toner having a desired particle diameter and a desired distribution thereof.

As the compound including a nitrogen atom, tertiary amine compounds are preferably used. Specific examples of the tertiary amine compounds include amine, amino alcohol, amino mercaptan and amidine. Specific examples of the amine include aromatic amine such as triphenyl amine and triallyl amine; and aliphatic amine such as triethyl amine and trimethyl amine. Specific examples of the amino alcohol include triethanol amine, dihydroxyethylaniline, etc. Specific examples of the amino mercaptan include triethanethiol amine, trimethanethiol amine, etc. Specific examples of the amidine include DBU (1,8-diaza-bicyclo[5.4.0]undecen-7), DBN (1,5-diaza-bicyclo[4.3.0]nonen-5), etc. Among these tertiary amine compounds, a compound having the following formula (I) is more preferably used because of having good solubility in an organic solvent and good formability of a salt with the unreactive polyester (C).

(I)

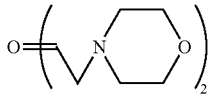

The toner constituents preferably include the tertiary amine compound in an amount of from 0.05 to 3% by weight to have an acid value and an amine value in the above-mentioned proper ranges respectively.

The present invention is characterized by using a urea-modified polyester resin formed from a reaction between the polyester prepolymer (A) and the amines (B) as a toner binder resin, and the other materials such as the unreactive polyester (C) (including a resin used for preparing a colorant master batch).

The toner binder resin of the present invention preferably has a glass transition temperature (Tg) of from 40 to 70° C., and more preferably from 45 to 55° C. When less than 40° C., a thermostable preservability of the resultant toner deteriorates. When greater than 70° C., a low-temperature fixability thereof is insufficient. The toner of the present invention including the crosslinked and/or elongated polyester resin has a better thermostable preservability than known polyester toners even though the glass transition temperature is low.

In the present invention, the toner binder resin preferably has a temperature (TG') at which a storage modulus of the toner binder resin is 1,000 Pa at a measuring frequency of 20 Hz of not less than 100° C., and more preferably of from 110 to 200° C. When less than 100° C., the hot offset resistance of the resultant toner deteriorates. The toner binder resin preferably has a temperature (Tη), at which the viscosity is 100 Pa·s of not greater than 180° C., and more preferably of from 90 to 160° C. When greater than 180° C., the low-temperature fixability of the resultant toner deteriorates. Namely, TG' is preferably higher than Tη in terms of the low-temperature fixability and hot offset resistance of the resultant toner. In other words, the difference between TG' and Tη (TG'−Tη) is preferably not less than 0° C., more preferably not less than 10° C., and furthermore preferably not less than 20° C. The maximum of the difference is not particularly limited. In terms of the thermostable preservability and low-temperature fixability of the resultant toner, the difference between TG' and Tη (TG'−Tη) is preferably from 0 to 100° C., more preferably from 10 to 90° C., and most preferably from 20 to 80° C.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone. These can be used alone or in combination.

In the process of granulating toner particles in an aqueous medium, a particulate resin is added thereto for the purpose of controlling a shape of the final toner, such as circularity and particle diameter distribution thereof. When the organic solvent and the compound including an active hydrogen atom (amines) are dispersed in the aqueous medium to form organic dispersed particles, the particulate resin is considered to bond with a surface thereof and is eccentrically-located on a surface of the resultant toner particles similarly to an external additive mentioned later.

The particulate resin is preferably dispersed in the aqueous medium before the organic solvent and the compound including an active hydrogen atom (amines) are dispersed are dispersed therein, and any thermoplastic and thermosetting resins capable of forming an aqueous dispersion can be used as the particulate resin. Specific examples of the resins include vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These can be used alone or in combination.

Among these resins, the vinyl resins, polyurethane resins, epoxy resin, polyester resins or combinations of these resins are preferably used because an aqueous dispersion of a fine-spherical particulate resin can easily be obtained. Specific examples of the vinyl resins include single-polymerized or copolymerized vinyl monomers such as styrene-ester(metha) acrylate resins, styrene-butadiene copolymers, (metha) acrylic acid-esteracrylate polymers, styrene-acrylonitrile copolymers, styrene-maleic acid anhydride copolymers and styrene-(metha)acrylic acid copolymers.

The toner of the present invention needs to include the particulate resin in an amount of from 0.5 to 5.0% by weight after an external additive is added thereto. When less than 0.5% by weight, storage stability of the resultant toner deteriorates, and blocking thereof occurs when stored and in an image developer. When greater than 5.0% by weight, the particulate resin prevents a wax from seeping to impair releasability of the resultant toner, resulting in occurrence of offset.

The content of the particulate resin can be determined from a peak area measured by analyzing a material with a pyrolysis gas chromatographic mass analyzer. The mass analyzer is preferably used, but is not limited thereto.

The content of the particulate resin in the aqueous medium may satisfy the above-mentioned condition.

The particulate resin preferably has a glass transition temperature (Tg) of from 40 to 100° C. and a weight-average molecular weight of from 9,000 to 200,000. When the glass transition temperature (Tg) is less than 40° C. and/or weight-average molecular weight is less than 9,000, storage stability of the resultant toner deteriorates, and blocking thereof occurs when stored and in an image developer. When the glass transition temperature (Tg) is greater than 80° C. and/or weight-average molecular weight is greater than 200,000, the particulate resin material impairs adherence of the resultant toner to a transfer paper and increase the fixable minimum temperature.

Specific examples of the colorants for use in the present invention include any known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazored, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

The colorant for use in the present invention can be used as a master batch pigment, if desired, when combined with a resin.

Specific examples of the resin for use in the master batch pigment or for use in combination with master batch pigment include the urea-modified polyester resin (A) and the unreactive polyester resin (C) mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed, can be preferably used because the resultant wet cake of the colorant can be used as it is. Of course, a dry powder which is prepared by drying the wet cake can also be used as a colorant. In this case, a three roll mill is preferably used for kneading the mixture upon application of high shearing stress.

The colorant or master batch can be dissolved or dispersed in the organic solvent, but are not necessarily dissolved or dispersed therein.

The toner of the present invention may include a wax together with a binder resin and a colorant. Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used. Specific examples thereof include polyesteralkanates such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanates such as ethylenediaminebehenylamide; polyalkylamides such as tristearylamidetrimellitate; and dialkylketones such as distearylketone. Among these waxes including a carbonyl group, a polyesteralkanate is preferably used.

The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature.

In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner.

The content of the wax in a toner is preferably from 0 to 40% by weight, and more preferably from 3 to 30% by weight. The wax can be dissolved or dispersed in the organic solvent, but are not necessarily dissolved or dispersed therein.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

The charge controlling agent can be dissolved and dispersed after kneaded upon application of heat together with a master batch pigment and a resin or can be added to toner constituents when dissolved and dispersed in an organic solvent, and is preferably fixed on the surface of toner particles.

The toner of the present invention can be prepared by the following method, but is not limited thereto.

As mentioned above, the toner particles are formed by dispersing an organic solvent phase in an aqueous medium wherein a particulate resin is dispersed as follows.

As mentioned above, the toner particles are formed by dispersing the organic solvent including the polyester prepolymer (A), the amines (B) and the tertiary amine compound in the aqueous medium to perform a cross-linking reaction and/or an elongation reaction among them to prepare a urea-modified polyester resin. As a method of stably preparing a dispersion formed of the polyester prepolymer (A) in the aqueous medium, a method of including toner constituents formed of the polyester prepolymer (A) dissolved or dispersed in an organic solvent into the aqueous medium and dispersing them upon application of shear stress is preferably used. The polyester prepolymer (A) and other toner constituents such as colorants, master batch pigments, release agents, charge controlling agents, unreactive polyester resins (C), etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method of dyeing particles previously formed without a colorant by a known dying method can also be used.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (while pressurized), and preferably from 40 to 98° C. When the temperature is relatively high, the polyester prepolymer (A) can easily be dispersed because the dispersion formed thereof has a low viscosity.

The content of the aqueous medium to 100 parts by weight of the toner constituents including the polyester prepolymer (A) is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have the desired particle diameter. In contrast, when the content is greater than 2,000, the production cost increases. A dispersant can preferably be used to prepare a stably dispersed dispersion including particles having a sharp particle diameter distribution.

Specific preferred examples of the dispersants used to emulsify and disperse the organic solvent including toner constituents including the polyester prepolymer (A), include anionic surfactants such as alkylbenzene sulfonic acid salts, α-olefin sulfonic acid salts, and phosphoric acid salts; cationic surfactants such as amine salts (e.g., alkyl amine salts, amino alcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride) ; nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOPEF-102, 103, 104, 105, 112, 123A, 306A, 501, 201 and 204, which are manufactured by Tohchem Products Co., Ltd.; FUTARGENT F-100 and F150 manufactured by Neos; etc. Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite, which are hardly soluble in water, can also be used.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle. However, the dispersant is preferably washed and removed after the cross-linking reaction and/or the elongation reaction.

The cross-linking reaction and/or the elongation reaction time depend on reactivity of the isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising the temperature of the whole dispersion to completely remove the organic solvent in the droplet by vaporizing can be used. Otherwise, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. The powder remaining after the dispersion liquid is dried can be classified, but the liquid is preferably classified in terms of efficiency. Unnecessary fine and coarse particles can be recycled to a kneading process to form particles. The fine and coarse particles may be wet when recycled.

Dispersant is preferably removed from the dispersion liquid, and more preferably removed at the same time when the above-mentioned classification is performed.

Heterogeneous particles such as release agent particles, charge controlling particles, fluidizing particles and colorant particles can be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

As an external additive to subsidize the fluidity, developability and chargeability of the toner of the present invention, a particulate inorganic material is preferably used. The particulate inorganic material preferably has an average primary particle diameter of from 5 nm to 2 μm, and more preferably from 5 to 500 nm. In addition, the particulate inorganic material preferably has a specific surface area of from 20 to 500 $m^2/g$ when measured by a BET method. The toner preferably includes the particulate inorganic material in an amount of from 0.01 to 5% by weight, and more preferably from 0.01 to 2.0% by weight.

Specific examples of the particulate inorganic material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Besides, polymer particulate materials, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins can be used.

Such fluidizers can be surface-treated with a surface treatment agent to increase the hydrophobicity to prevent deterioration of fluidity and chargeability even in an environment of high humidity. Specific examples of the surface treatment agent include a silane coupling agent, a sililating agents a silane coupling agent having an alkyl fluoride group, an organic titanate coupling agent, an aluminium coupling agent a silicone oil and a modified silicone oil.

It is essential that the toner of the present invention has a specific shape and a distribution thereof, and an amorphous toner having an average circularity less than 0.90 and far from sphericity does not have a satisfactory transferability and does not produce high-quality images. The shape of the toner is suitably measured by an optical detection method of passing a suspension liquid including a particle through a plate-shaped imaging detector to detect and analyze an image of the particle with a CCD camera. A peripheral length of a circle having an area equivalent to that of a projected image optically detected is divided by an actual peripheral length of the toner particle to determine the circularity of a toner. The toner preferably has an average circularity of from 0.975 to 0.900 to produce images having appropriate density, reproducibility and high definition, and more preferably from 0.970 to 0.950 and particles having a circularity less than 0.94 in an amount not greater than 15%. When the toner has an average circularity not less than 0.975, a photoreceptor and a transfer belt in an apparatus using a cleaning blade are poorly cleaned, resulting in production of contaminated images. When an image having a low image area is developed and transferred, a toner remains less and poor cleanability thereof does not become a problem. However, when an image having a high image area, such as a full-color images, or when an untransferred residual toner due to defective paper feeding is accumulated, images having background fouling are produced. Further, a contact charger such as a charging roller, charging a photoreceptor while contacting thereto, is contaminated, resulting in having poor chargeability. The circularity of the toner is measured by a flow-type particle image analyzer FPIA-2000 from SYSMEX CORPORATION.

The toner of the present invention preferably has a volume-average particle diameter (Dv) of from 3 to 6 μm, and a ratio (Dv/Dn) to a number-average particle diameter (Dn) not greater than 1.30, and more preferably from 1.10 to 1.20. Such a toner has a good thermostable preservability, a good low-temperature fixability and a good hot offset resistance, and above all has a good glossiness when used in a full-color copier.

Typically, it is said that the smaller the toner particle diameter, the more advantageous to produce high resolution and quality images. However, the small particle diameter of the toner is disadvantageous thereto to have transferability and cleanability. When the volume-average particle diameter is smaller than 4 μm, the resultant toner in a two-component developer melts and adheres to a surface of a carrier to deteriorate chargeability thereof when stirred for a long time in an image developer. When the toner is used in a one-component developer, toner filming over a developing roller and fusion bond of the toner to a blade forming a thin layer thereof tend to occur.

When the average particle diameter is larger than the scope of the present invention, the resultant toner has a difficulty in producing high resolution and quality images. In addition, the resultant toner has a large variation of the particle diameters in many cases after the toner in a developer is consumed and fed for long periods.

When Dv/Dn is greater than 1.30, the resultant toner has a wide charge quantity distribution and image resolution thereof deteriorates.

In the present invention, when the toner constituents having an acid value and an amine value in proper ranges respectively, the cross-linking reaction and/or the elongation reaction between the polyester prepolymer (A) and the amines (B) are uniformly performed. Controlling the reaction temperature and time can prepare a toner having the above-mentioned desired volume-average particle diameter and distribution thereof.

The particle diameter distribution thereof can be measured by a Coulter Counter TA-II or a Coulter Multisizer from Coulter Electronics, Inc. as follows:

0.1 to 5 ml of a detergent, preferably alkylbenzene sulfonate is included as a dispersant in 100 to 150 ml of the electrolyte ISOTRON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

Further, the toner of the present invention can be used as a magnetic toner when a magnetic material is included therein. Specific examples of the magnetic materials include iron oxides such as magnetite, hematite and ferrite; metals such as cobalt and nickel; or their metal alloys and mixtures with aluminium, copper, lead, magnesium, tin, zinc, stibium, beryllium, bismuth, cadmium, calcium, manganese, selenium, titanium, tungsten, vanadium, etc. Particularly, the magnetite is preferably used in terms of its magnetic property. The magnetic material preferably has an average particle diameter of from about 1 to 2 μm. The toner preferably includes the magnetic material in an amount of from 15 to 200 parts by weight, and preferably from 20 to 100 parts by weight per 100 parts by weight of the resins in the toner.

The toner of the present invention can be used as a two-component developer in combination with a magnetic carrier as well as one-component developer. Specific examples of the magnetic carrier include known carriers such as powders of iron, ferrite and nickel having magnetism; glass beads; and the powders and glass beads coated with a resin. Specific examples of the resin include styrene-acrylic copolymers, silicone resins, maleic acid resins, fluorocarbon resins, polyester resins, epoxy resins, etc. The styrene-acrylic copolymers preferably include styrene in an amount of form 30 to 90% by weight. When less than 30% by weight, the resultant developer has a low developability. When greater than 90% by weight, a coated film becomes hard and easy to peel, resulting in a short life of the resultant carrier. In addition, a material for coating the carrier may include an adhesion additive, a hardener, a lubricant, an electroconductive material, a charge controlling agent, etc. besides the resin.

FIGURE is a perspective view illustrating an embodiment of the image forming apparatus of the present invention, wherein a copier 100 includes a paper feeding table 200, a scanner 300 thereon and a document feeder (ADF) 400 on the scanner.

The copier 100 includes a tandem-type image forming apparatus 20 including four image forming devices 18 in parallel, including means for performing electrophotographic processes such as charging, developing and cleaning around a photoreceptor 40 as a latent image bearer. Above the tandem-type image forming apparatus 20, an irradiator 21 is located irradiating the photoreceptor 40 with a laser beam based on image information to form a latent image thereon. An intermediate transfer belt 10, formed of an endless belt, is located facing each photoreceptor 40 in the tandem-type image forming apparatus 20. A transferer 62, transferring a toner image of each color formed on the photoreceptors 40 onto the intermediate transfer belt 10, is located facing the photoreceptor 40 through the intermediate transfer belt 10.

A second transferer 22, transferring the toner images overlapped on the intermediate transfer belt 10 at a time onto a transfer paper fed from the paper feeding table 200, is located below the intermediate transfer belt 10. The second transferer 22 includes an endless second transfer belt 24 running between two roller 23 with tension, and is pressed against a support roller 16 through the intermediate transfer belt 10 to transfer the toner images thereon onto the transfer paper. A fixer 25 fixing the toner image on the transfer paper is located beside the second transferer 22. The fixer 25 includes an endless fixing belt 26 and a pressure roller 27 pressed against the fixing belt 26.

The second transferer 22 also transports the transfer paper having the transferred image on to the fixer 25. The second transferer 22 may include a transfer roller and a non-contact charger, and in that case, the second transferer 22 is difficult to transport the transfer paper.

In this embodiment, a reverser 28 reversing the transfer paper to record images on both sides thereof is located below the second transferer 22 and the fixer 25 in parallel with the tandem-type image forming apparatus 20.

A developer including the toner of the present invention is used in an image developer 4 in the image forming device 18. The image developer 4 bears and transports the developer with a developer bearer to a position facing the photoreceptor 40 to develop the latent image thereon upon application of an alternative electric field. The alternative electric field activates the developer, limits a charge quantity distribution of the toner and improves developability thereof.

The image developer 4 together with the photoreceptor 40 can be a process cartridge detachable with an image forming apparatus. The process cartridge may include a charger and a cleaner besides the image developer and the photoreceptor.

The image forming apparatus works as follows.

First, an original is set on an original table 30 of the ADF 400, or on a contact glass 32 of the scanner 300 after opening the ADF 400, and the ADF 400 is closed to press the original.

When a start switch (not shown) is pushed, after the original on the original table 30 is transported onto the contact glass 32, and immediately when the original is set thereon, the scanner 300 works to run a first runner 33 and a second runner 34. The first runner 33 emits light from its light source and reflects reflected light from the original toward the second runner 34. The second runner 34 reflects the light with a mirror to a reading sensor 36 through an image forming lens 35 to read the image information.

When a start switch (not shown) is pushed, a drive motor (not shown) rotates one of support rollers 14, 15 and 16, and the other two rollers are rotated in accordance with the roller driven by the motor to drive the intermediate transfer belt 10. At the same time, each image forming device 18 rotates the photoreceptor 40 and forms a single color image of black, yellow, magenta and cyan thereon, and each single color image is transferred in order on the intermediate transfer belt 10 to form a composite color image thereon.

When a start switch (not shown) is pushed, one of paper feeding rollers 42 of the paper feeding table 200 is selectively rotated to pick up the transfer paper from one of multiple-stage paper feeding cassettes 44, and a separation roller 45 separates the transfer papers one by one and transfers the transfer paper to a paper feeding route 46. A transfer roller 47 leads the transfer paper to a paper feeding route 48 in the copier 100 and the transfer paper is stopped against a resist roller 49.

Alternatively, a paper feeding roller 50 is rotated to pick up the transfer paper on a manual feeding tray 51. A separation roller 52 separates the transfer papers one by one and transfers the transfer paper to a paper feeding route 53, and the transfer paper is stopped against the same resist roller 49.

Then, the resist roller 49 is timely rotated when the composite color image is formed on the intermediate transfer belt 10 to transfer the transfer paper to a gap between the intermediate transfer belt 10 and the second transferer 22, and the second transferer transfers the composite color image onto the transfer paper.

The transfer paper having the transferred image is transferred to the fixer 25 by the second transferer 22. After the toner image is fixed on the transfer paper upon application of pressure and heat, a switch-over pick 55 switches over the transfer paper and a delivery roller 56 delivers the transfer paper onto a delivery tray 57. Alternatively, the switch-over pick 55 switches over the transfer paper to the reverser 28 revering the transfer paper and leading the transfer paper again to the transfer position to transfer an image on a backside thereof, and the delivery roller 56 delivers the transfer paper onto the delivery tray 57.

The intermediate transfer belt 10 removes a residual toner remaining thereon after transferred with an intermediate transfer belt cleaner 17, and is prepared for another image formation by the tandem-type image forming apparatus 20.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Particulate Resin Emulsion 683 parts of water, 11 parts of a sodium salt of an adduct of a sulfuric ester with ethyleneoxide methacrylate (ELEMINOL RS-30 from Sanyo Chemical Industries, Ltd.), 80 parts of styrene, 83 parts of methacrylate, 110 parts of butylacrylate, 12 parts of N-butyl thioglycolate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% by weight were added thereto and the mixture was aged for 5 hrs at 75° C. to prepare an aqueous dispersion a [particulate dispersion liquid 1] of a vinyl resin (a copolymer of a sodium salt of an adduct of styrene-methacrylate-butylacrylate-sulfuric ester with ethyleneoxide methacrylate). A volume-average of the [particulate dispersion liquid 1] was 120 nm when measured by a laser diffraction particle diameter distribution measurer LA-920 from Shimadzu Corp. Apart of the [particulate dispersion liquid 1] was dried to isolate a resin component therefrom. The resin component had a Tg of 42° C. and a weight-average molecular weight of 30,000.

Preparation of Aqueous Phase 990 parts of water, 65 parts of the [particulate dispersion liquid 1], 37 parts of an aqueous solution of sodium dodecyldiphenyletherdisulfonate having a concentration of 48.5% by weight (ELEMINOL MON-7 from Sanyo Chemical Industries, Ltd.) and 90 parts of ethyl acetate were mixed and stirred to prepare a lacteous liquid an [aqueous phase 1].

Preparation of Low-molecular-weight Polyester

Low-molecular-weight Polyester 1

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 44 parts of trimellitic acid anhydride were added thereto and the mixture was reacted for 2 hrs at a normal pressure and 180° C. to prepare a [low-molecular-weight polyester 1]. The [low-molecular-weight polyester 1] had a number-average molecular weight of 2,500, a weight-average molecular weight of 6,600, a Tg of 44° C. and an acid value of 25 mg KOH/g.

Low-molecular-weight polyester 2

229 parts of an adduct of bisphenol A with 2 moles of ethyleneoxide, 529 parts of an adduct of bisphenol A with 3 moles of propyleneoxide, 208 parts terephthalic acid, 37.2 parts of succinic acid, 2 parts of dibutyltinoxide and 18 parts of trimellitic acid anhydride were reacted in a reactor vessel including a cooling pipe, a stirrer and a nitrogen inlet pipe for 8 hrs at a normal pressure and 230° C. Further, the mixture was depressurized to 10 to 15 mm Hg and reacted for 5 hrs to prepare a [low-molecular-weight polyester 2]. The [low-molecular-weight polyester 2] had a number-average molecular weight of 2,400, a weight-average molecular weight of 6,300, a Tg of 45° C. and an acid value of 10 mg KOH/g.

Low-molecular-weight Polyester 3

229 parts of an adduct of bisphenol A with 2 moles of ethyleneoxide, 529 parts of an adduct of bisphenol A with 3 moles of propyleneoxide, 208 parts terephthalic acid, 37.2 parts of succinic acid, 2 parts of dibutyltinoxide and 60 parts of trimellitic acid anhydride were reacted in a reactor vessel including a cooling pipe, a stirrer and a nitrogen inlet pipe for 8 hrs at a normal pressure and 230° C. Further, the mixture was depressurized to 10 to 15 mm Hg and reacted for 5 hrs to prepare a [low-molecular-weight polyester 3]. The [low-molecular-weight polyester 2] had a number-average molecular weight of 2,400, a weight-average molecular weight of 6,600, a Tg of 43° C. and an acid value of 30 mg KOH/g.

Low-molecular-weight Polyester 4

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 10 parts of trimellitic acid anhydride were added thereto and the mixture was reacted for 2 hrs at a normal pressure and 180° C. to prepare a [low-molecular-weight polyester 4]. The [low-molecular-weight polyester 4] had a number-average molecular weight of 2,500, a weight-average molecular weight of 6,600, a Tg of 44° C. and an acid value of 4 mg KOH/g.

Low-molecular-weight Polyester 5

740 g of polyoxypropylene(2,2)-2,2-bis (4-hydroxyphenyl)propane, 300 g of polyoxyethylene(2,2)-2,2-bis(4-hydroxyphenyl)propane, 466 g of dimethyl terephthalate, 80 g of isododecenyl succinate anhydride and 114 g of tri-n-butyl-1,2,4-benzenetricarbonate were reacted with an esterification catalyst in a reactor vessel including a cooling pipe, a stirrer and a nitrogen inlet pipe. The mixture was heated to have a temperature of 210° C. at a normal pressure and stirred while reducing the pressure in a nitrogen atmosphere to prepare a [low-molecular-weight polyester 5]. The [low-molecular-weight polyester 5] had a number-average molecular weight of 3,000, a weight-average molecular weight of 13,600, a Tg of 62° C. and an acid value of 18 mg KOH/g.

Preparation of Intermediate Polyester 682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs to prepare an [intermediate polyester 1]. The [intermediate polyester 1] had a number-average molecular weight of 2,100, a weight-average molecular weight of 9,500, a Tg of 55° C. and an acid value of 0.5 mg KOH/g and a hydroxyl value of 51 mg KOH/g.

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

Preparation of Ketimine 170 parts of isophorondiamine and 75 parts of methyl ethyl ketone were reacted at 50° C. for 5 hrs in a reaction vessel including a stirrer and a thermometer to prepare a [ketimine compound 1]. The [ketimine compound 1] had an amine value of 418 mg KOH/g.

Example 1

Preparation of Oil Phase 640 parts of the [low-molecular-weight polyester 1], 110 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 160 parts of carbon black (Regal 400R from Cabot Corp.) and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 1] and the mixture was stirred by the beads mill for 1 pass under the same conditions to prepare a [pigment and wax dispersion liquid 1]. The [pigment and wax dispersion liquid 1] had a solid content concentration of 50% at 130° C. for 30 min.

Emulsification 648 parts of the [pigment and wax dispersion liquid 1], 154 parts of the [prepolymer 1] and 8.5 parts of the [ketimine compound 1] were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 10,000 rpm for 20 min to prepare an [emulsified slurry 1].

Namely, the [pigment and wax dispersion liquid 1], the [prepolymer 1] and the [ketimine compound 1] were dispersed in an aqueous medium including a particulate resin, and subjected to an elongation reaction.

De-solvent

The [emulsified slurry 1] was put in a vessel including a stirrer and a thermometer. After a solvent was removed from the emulsified slurry 1 at 30° C. for 8 hrs, the slurry was aged at 45° C. for 24 hrs to prepare a [dispersion slurry 1].

Washing and Drying

After the [dispersion slurry 1] was filtered under reduced pressure, 100 parts of ion-exchange water were added to the filtered cake and mixed by the TK-type homomixer at 12,000 rpm for 10 min, and the mixture was filtered.

Further, 100 parts of an aqueous solution of sodium hydrate having a concentration of 10% by weight were added to the filtered cake and mixed by the TK-type homomixer at 12,090 rpm for 10 min, and the mixture was filtered under reduced pressure.

Further, 100 parts of 10% hydrochloric acid were added to the filtered cake and mixed by the TK-type homomixer at 12,000 rpm for 10 min, and the mixture was filtered.

Further, 300 parts of ion-exchange water were added to the filtered cake and mixed by the TK-type homomixer at 12,000 rpm for 10 min, and the mixture was filtered. This operation was performed twice to prepare a [filtered cake 1].

The [filtered cake 1] was dried by an air drier at 45° C. for 48 hrs and sieved by a mesh having an opening of 75 μm to prepare a [toner particle 1].

Application of External Additive 0.7 parts of hydrophobic silica and 0.3 parts of hydrophobic titanium oxide was mixed with 100 parts of the [toner particle 1] by HENSCHEL MIXER to prepare a toner.

Example 2

The procedure for preparation of the toner in Example 1 was repeated to prepare a toner except for changing the conditions of the emulsification as follows.

Emulsification 648 parts of the [pigment and wax dispersion liquid 1], 154 parts of the [prepolymer 1], 8.5 parts of the [ketimine compound 1] and 1.0 part of the tertiary amine compound having the formula (I) were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 10,000 rpm for 20 min to prepare an [emulsified slurry 2].

Example 3

The procedure for preparation of the toner in Example 1 was repeated to prepare a toner except for changing the conditions of the emulsification as follows.

Emulsification 648 parts of the [pigment and wax dispersion liquid 1], 154 parts of the [prepolymer 1], 25parts of the [ketimine compound 1] and 2 parts of the tertiary amine compound having the formula (I) were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 10,000 rpm for 20 min to prepare an [emulsified slurry 3].

Example 4

The procedure for preparation of the toner in Example 1 was repeated to prepare a toner except for changing the [low-molecular-weight polyester 1] to the [low-molecular-weight polyester 2].

Example 5

The procedure for preparation of the toner in Example 2 was repeated to prepare a toner except for changing the [low-molecular-weight polyester 1] to the [low-molecular-weight polyester 2].

Example 6

The procedure for preparation of the toner in Example 1 was repeated to prepare a toner except for changing the conditions of the preparation of oil phase and the emulsification as follows.

Preparation of Oil Phase 640 parts of the [low-molecular-weight polyester 2], 110 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 160 parts of carbon black (Regal 400R from Cabot Corp.) and 500 parts of ethyl acetate were added to the mixture and mixed for 1 hr to prepare a [material solution 2].

1,434 parts of the [material solution 2] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 2] having a concentration of 60% were added to the [material solution 2] and the mixture was stirred by the beads mill for 1 pass under the same conditions to prepare a [pigment and wax dispersion liquid 2]. The

[pigment and wax dispersion liquid 2] had a solid content concentration of 46% at 130° C. for 30 min.

Emulsification 704 parts of the [pigment and wax dispersion liquid 2], 154 parts of the [prepolymer 1] and 8.5 parts of the [ketimine compound 1] were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 10,000 rpm for 20 min to prepare an [emulsified slurry 4].

Example 7

The procedure for preparation of the toner in Example 4 was repeated to prepare a toner except for changing the conditions of the emulsification as follows.

Emulsification 648 parts of the [pigment and wax dispersion liquid 1], 154 parts of the [prepolymer 1], 5parts of the [ketimine compound 1] and 3 parts of the tertiary amine compound having the formula (I) were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 10,000 rpm for 20 min to prepare an [emulsified slurry 5].

Example 8

Preparation of Master Batch 1,200 parts of water, 40 parts of carbon black (Regal 400R from Cabot Corp.), 40 parts of the [low-molecular-weight polyester 5] and 20 parts of an amine salt of polyester acid amide DA-725 having an acid value of 20 mg KOH/g and an amine value of 48 mg KOH/g from Kusumoto Chemicals, Ltd. were mixed by HENSCHEL MIXER from Mitsui Mining Co., Ltd., and further 30 parts of water were mixed in the mixture thereby. The mixture was kneaded by a two-roll mill at 150° C. for 30 min, and the kneaded mixture was extended upon application of pressure and cooled. The cooled and solidified mixture was pulverized by a pulverizer to prepare a [master batch 1].

Kneading, Pulverizing and Classifying

The following materials were mixed by HENSCHEL MIXER.

| | |
|---|---|
| Low-molecular-weight polyester 5 | 100 |
| Master batch 1 | 10 |
| Salt of zinc salicylate (BONTRON E-84 from Orient Chemical Industries, Ltd.) | 3 |

The mixture was melted and kneaded by a biaxial kneader TEM48 from Toshiba Machine Co., Ltd., and the kneaded mixture was extended upon application of pressure and cooled. The cooled and solidified mixture was pulverized by a jet mill pulverizer using a collision board (I-2 type mill from Nippon Pneumatic Mfg. Co., Ltd., and the pulverized mixture was classified by a wind force classifier using a swirling flow (DS classifier from Nippon Pneumatic Mfg. Co., Ltd.) to prepare toner particles.

Further, similarly to Example 1, 0.7 parts of hydrophobic silica and 0.3 parts of hydrophobic titanium oxide was mixed with 100 parts of the toner particle by HENSCHEL MIXER to prepare a toner.

Comparative Example 1

The procedure for preparation of the toner in Example 1 was repeated to prepare a toner except for changing the [low-molecular-weight polyester 1] to the [low-molecular-weight polyester 3].

Comparative Example 2

The procedure for preparation of the toner in Example 2 was repeated to prepare a toner except for changing the [low-molecular-weight polyester 1] to the [low-molecular-weight polyester 3].

Comparative Example 3

The procedure for preparation of the toner in Example 1 was repeated to prepare a toner except for changing the conditions of the emulsification as follows.

Emulsification 648 parts of the [pigment and wax dispersion liquid 1], 154 parts of the [prepolymer 1], 30 parts of the [ketimine compound 1] and 1 part of the tertiary amine compound having the formula (I) were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 10,000 rpm for 20 min to prepare an [emulsified slurry 6].

Comparative Example 4

The procedure for preparation of the toner in Example 1 was repeated to prepare a toner except for changing the [low-molecular-weight polyester 1] to the [low-molecular-weight polyester 4], and the conditions of the emulsification as follows.

Emulsification 648 parts of the [pigment and wax dispersion liquid 1], 154 parts of the [prepolymer 1], 25 parts of the [ketimine compound 1] and 2 parts of the tertiary amine compound having the formula (I) were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 10,000 rpm for 20 min to prepare an [emulsified slurry 7].

Comparative Example 5

The procedure for preparation of the toner in Example 1 was repeated to prepare a toner except for changing the [low-molecular-weight polyester 1] to the [low-molecular-weight polyester 4].

The acid values and amine values of the toner constituents in an organic solvent of Examples 1 to 8 and Comparative Examples 1 to 5 are shown in Table 1.

TABLE 1

| | | | Toner Constituents | |
|---|---|---|---|---|
| | Acid value of low-molecular-weight polyester (mg KOH/g) | Tertiary amine compound | Acid value (mg KOH/g) | Amine value (mg KOH/g) |
| Ex. 1 | 25 | Without | 10 | 5 |
| Ex. 2 | 25 | With | 8 | 5.5 |

TABLE 1-continued

| | Acid value of low-molecular-weight polyester (mg KOH/g) | Tertiary amine compound | Toner Constituents: Acid value (mg KOH/g) | Toner Constituents: Amine value (mg KOH/g) |
|---|---|---|---|---|
| Ex. 3 | 25 | With | 10 | 12 |
| Ex. 4 | 10 | Without | 3 | 5 |
| Ex. 5 | 10 | With | 3 | 5.5 |
| Ex. 6 | 10 | Without | 2 | 5 |
| Ex. 7 | 10 | With | 3 | 10.3 |
| Ex. 8 | 18 | Without | — | — |
| Com. Ex. 1 | 4 | Without | 2 | 5 |
| Com. Ex. 2 | 4 | With | 2 | 5.5 |
| Com. Ex. 3 | 25 | Without | 10 | 15 |
| Com. Ex. 4 | 30 | Without | 30 | 12 |
| Com. Ex. 5 | 30 | Without | 30 | 5 |

<Evaluation Method>

Preparation of Developer

A two-component developer was prepared, which includes the toner of the present invention in an amount of 5% by weight and a copper-zinc ferrite carrier coated with a silicone resin, having an average particle diameter of 40 μm, in an amount of 95% by weight.

50,000 images were continuously produced by imagio Neo 450 from Ricoh Company, Ltd., which is capable of producing 45 A4 images a minute using the developer, and the following items were evaluated by the respective methods. The evaluation results are shown in Table 2.

Evaluation Items (1) Volume-average Particle Diameter and Distribution (Dv/Dn) of Toner The volume-average particle diameter (Dv) and number-average particle diameter (Dn) of a toner were measured by Coulter counter TA-II from Coulter Electronics, Inc. with an aperture diameter of 100 μm.

(2) Acid Value/Amine Value

The acid value (mg KOH/g) of a toner was measured according to JISK 0070, and the amine value (mg KOH/g) thereof was measured according to ASTM D 2074.

(3) Charge Quantity 6 g of the developer were put in a metallic cylinder and blown to measure charge quantity thereof. The developer was controlled to have a toner concentration of from 4.5 to 5.5% by weight.

(4) Toner Scattering

After 50,000 images were produced, toner contamination in the apparatus was observed.

No toner contamination: ○

Slightly contaminated, but usable: Δ

Noticeably contaminated, and unusable: ×

(5) Fixability

A solid image was produced on an ordinary transfer paper and a thick transfer paper, i.e., TYPE 6200 from Ricoh Company, Ltd. and Copy Paper <135> from NBS RICOH Co., Ltd. such that a toner adhered thereto in an amount of 0.85±0.1 mg/cm$^2$. A temperature of the fixing belt was changed to perform a fixing test and a maximum temperature at which the hot offset does not occur on the ordinary transfer paper was determined as a maximum fixable temperature. A temperature at which the image density of an image produced on the thick paper had a residual ratio not less than 70% was determined as a minimum fixable temperature.

Maximum fixable temperature:

190° C. or more: ◎

180 to less than 190° C.: ○

170 to less than 180° C.: Δ less than 170° C.: ×

Minimum fixable temperature:

135° C. of less: ◎ more than 135 to 145° C.: ○ more than 145 to 155° C.: Δ more than 155° C.: ×

TABLE 2

| | Dv(μm) | Dv/Dn | Acid/Amine: Acid value | Acid/Amine: Amine value | D | Charge Qty: Start | Charge Qty: After 50,000 | Toner Scattering: After 50,000 | Fixability: Min. | Fixability: Max. | GA |
|---|---|---|---|---|---|---|---|---|---|---|---|
| Ex. 1 | 5.05 | 1.22 | 18 | 2 | 16 | 25.1 | 24.6 | ○ | ○ | ○ | ○ |
| Ex. 2 | 4.95 | 1.15 | 18 | 2 | 16 | 26.7 | 23.7 | ○ | ○ | ○ | ◎ |
| Ex. 3 | 5.15 | 1.25 | 18 | 10 | 8 | 22.3 | 18.5 | ○ | ○ | ○ | Δ |
| Ex. 4 | 5.06 | 1.28 | 7 | 2 | 5 | 25.6 | 24.3 | ○ | ○ | ○ | ○ |
| Ex. 5 | 5.35 | 1.19 | 7 | 2 | 5 | 26.1 | 23.8 | ○ | ○ | ○ | ◎ |
| Ex. 6 | 5.08 | 1.34 | 7 | 2 | 5 | 22.3 | 21.7 | ○ | ○ | ○ | Δ |
| Ex. 7 | 5.01 | 1.17 | 7 | 6 | 1 | 25.7 | 19.8 | Δ | ○ | ○ | Δ |
| Ex. 8 | 5.51 | 1.28 | 18 | 1 | 17 | 22.3 | 20.1 | Δ | Δ | ○ | Δ |
| Com. Ex. 1 | 5.13 | 1.32 | 3 | 2 | 1 | 25.6 | 21.8 | Δ | X | ○ | X |
| Com. Ex. 2 | 5.28 | 1.21 | 3 | 2 | 1 | 21.3 | 19.3 | ○ | X | ○ | X |
| Com. Ex. 3 | 5.34 | 1.28 | 18 | 13 | 5 | 20.5 | 15.6 | X | ○ | ○ | X |

TABLE 2-continued

| | | | Acid/ Amine | | | Charge Qty | | Toner Scattering | | | |
|---|---|---|---|---|---|---|---|---|---|---|---|
| | | | Acid | Amine | | | After | After | Fixability | | |
| | Dv(μm) | Dv/Dn | value | value | D | Start | 50,000 | 50,000 | Min. | Max. | GA |
| Com. Ex. 4 | 5.15 | 1.26 | 22 | 10 | 12 | 26.3 | 11.3 | X | ○ | Δ | X |
| Com. Ex. 5 | 5.05 | 1.27 | 22 | 2 | 20 | 29.9 | 18.5 | X | ○ | Δ | X |

D: difference
GA: General Assessment

Table 2 proves that the toners of the present invention in Examples 1 to 8, which have acid values and amine values in proper ranges respectively, have good negative chargeability, less toner scattering and good fixability.

This application claims priority and contains subject matter related to Japanese Patent Application No. 2004-073823 filed on Mar. 16, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner which is negatively charged comprising:

a colorant; and a binder resin, wherein the toner has an acid value of from 5 to 20 mg KOH/g and an amine value of from 0.5 to 10 mg KOH/g, wherein the toner is prepared by a method comprising:

dissolving or dispersing toner constituents comprising a resin component comprising at least one of a polymerizing monomer and a binder resin, and a tertiary amine compound, in an organic solvent to prepare a solution or a dispersion, wherein the tertiary amine compound has the following formula (I):

(I)

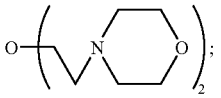

and dispersing the solution or the dispersion in an aqueous medium.

2. The toner of claim 1, wherein the acid value is larger than the amine value by not less than 2 mg KOH/g.

3. The toner of claim 1, wherein the toner constituents further comprise:

a colorant, wherein the resin component comprises:

a polyester prepolymer having a functional group including a nitrogen atom; and a polyester resin, and wherein the toner constituents in the solution or dispersion are subjected to at least one of a cross-linking reaction and an elongation reaction in the aqueous medium.

4. The toner of claim 1, wherein the toner constituents have an acid value larger than an amine value thereof by 3 to 10 mg KOH/g.

5. The toner of claim 4, wherein the acid value is from 3 to 15 mg KOH/g and the amine value is from 0.5 to 12 mg KOH/g.

6. The toner of claim 1, wherein the toner constituents comprise the tertiary amine compound in an amount of from 0.05 to 3% by weight.

7. The toner of claim 1, wherein the toner has a volume-average particle diameter (Dv) of from 3 to 6 μm, and a ratio (Dv/Dn) of the volume-average particle diameter (Dv) to a number-average particle diameter (Dn) of from 1.0 to 1.3.

8. A two-component developer comprising:

a magnetic carrier; and the toner according to claim 1.

9. An image developer comprising:

a developer bearer configured to bear a developer; and an applicator configured to apply an electric field to a latent image formed on a latent image bearer at a position facing the latent image bearer to develop the latent image with the developer, wherein the developer comprises the toner according to claim 1.

10. A process cartridge detachable from an image forming apparatus, comprising:

a latent image bearer configured to bear an electrostatic latent image; and an image developer configured to develop the electrostatic latent image with a developer, wherein the image developer is the image developer according to claim 9.

11. An image forming apparatus comprising:

a latent image bearer;

a charger configured to charge the latent image bearer;

an irradiator configured to form an electrostatic latent image on the latent image bearer;

an image developer configured to develop the electrostatic latent image with a developer to form a toner image on the latent image bearer;

a transferer configured to transfer the toner image onto a transfer sheet; and a fixer configured to fix the toner image on the transfer sheet, wherein the image developer is the image developer according to claim 9.

* * * * *